United States Patent [19]

Lampe

[11] 4,366,550

[45] Dec. 28, 1982

[54] MONOLITHIC SEQUENTIAL PROCESSOR FOR FOUR-QUADRANT MULTIPLIER ARRAYS

[75] Inventor: Donald R. Lampe, Ellicott City, Md.

[73] Assignee: Westinghouse Electric Corp., Pittsburgh, Pa.

[21] Appl. No.: 227,431

[22] Filed: Jul. 28, 1980

Related U.S. Application Data

[63] Continuation of Ser. No. 3,459, Jan. 15, 1979, abandoned.

[51] Int. Cl.[3] ..... G06G 7/16

[52] U.S. Cl. ..... 364/844; 307/221 D; 357/24; 364/862

[58] Field of Search ..... 364/862, 841, 844, 819, 364/824; 307/221 D; 357/24

[56] References Cited

U.S. PATENT DOCUMENTS 3,942,035 3/1976 Buss ..... 307/221 D
4,034,199 7/1977 Lampe et al. ..... 364/862 X
4,058,717 11/1977 Engeler ..... 364/862 X
4,084,256 4/1978 Engeler et al. ..... 364/862

*Primary Examiner*—Joseph F. Ruggiero
*Attorney, Agent, or Firm*—W. G. Sutcliff

[57] ABSTRACT

An integrated circuit sequential processor includes a charge-coupled device having input and output diffusion regions in a semiconductor substrate and a plurality of electrodes therebetween on an insulating layer formed on the semiconductor substrate. Switching means are coupled between an analog signal input and the electrodes for selectively applying a sequence of voltage potentials to the electrodes in order to meter onto the capacitor formed at the output diffusion region, charge corresponding to the sequence of voltage potentials. A circuit including a potential converting means is coupled to the output diffusion region for storing a potential indicative of the charge on the capacitor formed at the output diffusion region. The circuit also includes an output capacitor for providing an output potential indicative of the potential on the storing capacitor in response to a signal.

29 Claims, 12 Drawing Figures

FIG. 5
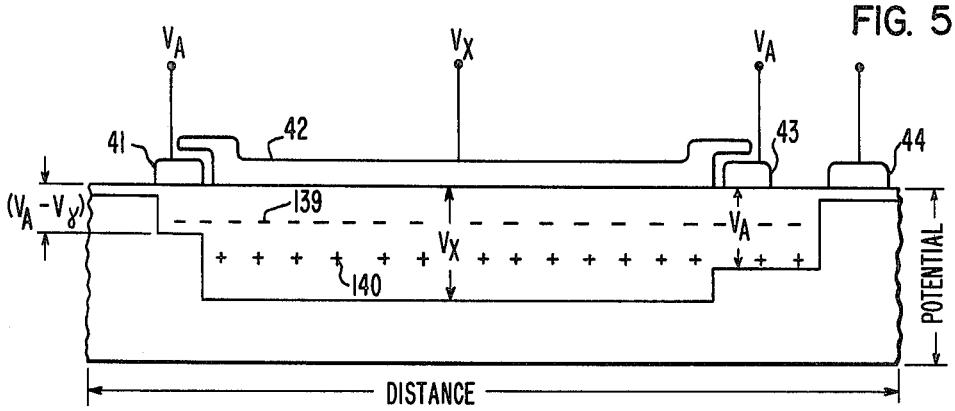
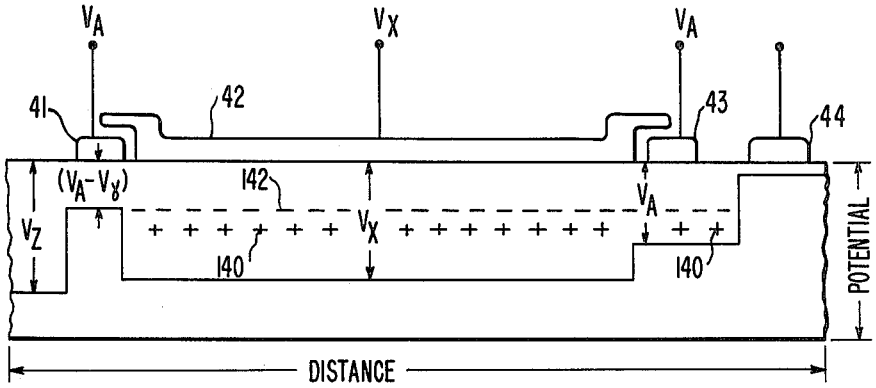
FIG. 6
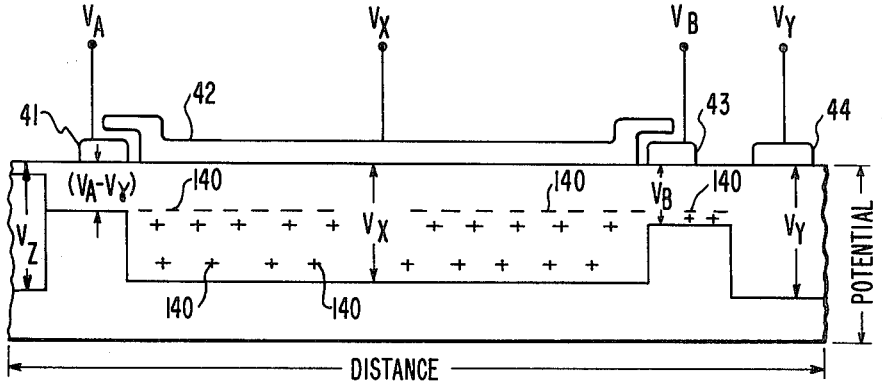
FIG. 7

MONOLITHIC SEQUENTIAL PROCESSOR FOR FOUR-QUADRANT MULTIPLIER ARRAYS

GOVERNMENT CONTRACT

The invention herein described was made in the course of or under a contract or subcontract thereunder with the National Aeronautics and Space Administration.

This is a continuation of application Ser. No. 003,459, filed Jan. 15, 1979, now abandoned.

CROSS-REFERENCE TO RELATED PENDING APPLICATIONS

An application entitled "CMOS Analog Multiplier for CCD Signal Processing" by Lampe, et al., Ser. No. 842,866, filed Oct. 17, 1977 U.S. Pat. No. 4,156,924, is of interest for its disclosure of a balanced differential conductance-type MOS transistor multiplier using complementary MOS transistors.

Application Ser. No. 842,834 filed Oct. 17, 1977 U.S. Pat. No. 4,156,923, entitled "Method and Apparatus For Performing Matrix Multiplication OR Analog Signal Correlation", by Lampe et al., is of interest for its disclosure of a method for producing a sum-of-products of samples of first and second analog signals including a four-step sequential process whereby erroneous contributions to the output sum-of-products are eliminated.

Application Ser. No. 867,844 filed Jan. 9, 1978, abandoned, which is a division of U.S. Pat. No. 4,085,444 issued on Apr. 18, 1978 to John L. Fagan and assigned to the common assignee is directed to a method for subtracting a first discrete analog signal from a second discrete analog signal in a channel of a charge-coupled device.

CROSS-REFERENCE TO RELATED PATENTS

U.S. Pat. No. 4,035,629 by Lampe, et al., issued July 12, 1977, assigned to the common assignee is of interest which discloses an extended correlated doubling sampling system which corrects for errors in components of the system.

U.S. Pat. No. 4,079,238 issued on Mar. 14, 1978, entitled "A Dual-CCD Real Time, Fully-Analog Correlator", by Lampe, et al., is of interest for its disclosure of a general-purpose fully analog correlator including two CCD channels for processing samples of analog signals and MOSFET multipliers for providing products of the signal samples.

BACKGROUND OF THE INVENTION

1. Field of the Invention

This invention relates to charge-coupled devices for metering charge and, more particularly, to a circuit for metering electrical charge for forming a signal indicative of a function of input signals to said circuit.

2. Description of the Prior Art

Matrix multiplication of analog signals and, in particular, analog signal correlation, for example, has been performed by such techniques as converting the analog signals to digital signals and performing digital multiplication or correlation. However, such A/D conversion techniques require large amounts of hardware which uses relatively large amounts of space and decreases system reliability.

It is desirable, therefore, to devise a method and apparatus for analog signal matrix multiplication or correlation which does not include A/D conversion.

However, the technology disclosed in the above application Ser. No. 842,834, a hybrid U.S. Pat. No. 4,156,923 combination of discrete components such as capacitors and transistors. An integrated, monolithic device is needed so that it can be fabricated at the same time and on the same chip as the charge transfer devices that perform the signal correlation. Also, spurious effects due to parasitic capacitances such as noise pickup causes degraded performance.

SUMMARY OF THE INVENTION

A circuit for metering electrical charge corresponding to a sequence of input signals and for providing an output potential voltage indicative of the sequence of input signals includes an input section which includes switching apparatus for providing the sequence of input signals or voltage potentials. A charge-coupled device (CCD) is coupled to the input section for providing or metering charge indicative of said sequence of potentials. A circuit is coupled to the CCD, which circuit includes an input capacitor for storing a voltage potential thereacross indicative of charge in the CCD. The circuit also includes an input capacitor for storing a voltage potential thereacross indicative of charge to be metered into the CCD. The circuit also includes an output capacitor for providing, in response to a signal, an output voltage potential indicative of the voltage potential then existing across the input capacitor.

More particularly, a CCD is provided having input and output diffusion regions in a semiconductor substrate and a plurality of electrodes therebetween on an insulating layer formed on the semiconductor substrate. The circuit coupled to the output diffusion diode includes an input capacitor, a metal-oxide semiconductor (MOS) transistor buffer circuit coupled between the input capacitor and the output diffusion region for appropriately matching impedances therebetween. An MOS transistor switch is coupled to the other side of the input capacitor and to AC ground, responsive to a signal for impressing across the input capacitor a potential voltage indicative of charge in the capacitor formed at the output diffusion diode. The circuit also includes a grounded output capacitor coupled by an impedance matching MOS transistor buffer circuit to an output line. A third impedance matching MOS transistor circuit is coupled between the input capacitor and the output capacitor. Responsive to a signal, an MOS transistor switch coupled between the output capacitor and the third MOS buffer couples the input capacitor and the output capacitor. An MOS transistor switch is coupled between ground and the output diffusion region of the CCD for removing the charge therein in response to a digital signal.

In one embodiment, the input section comprises a switch coupled to the analog input signals or voltage potentials for applying the input signals to a first electrode of the CCD in response to a digital signal. A capacitor is coupled to the first electrode for maintaining it at the voltage potential applied thereto. A second electrode is directly coupled to the input signals and a holding well electrode between the first and second electrodes has a constant potential applied to it. A source of charge is coupled to the input diffusion region for injecting electrical charge into the CCD such that potential wells created under the first, second and holding well electrodes by voltage potentials applied thereto are filled with charge. Charge proportionate to a sequence of the voltage potentials is metered over a potential barrier created under the second electrode into a potential well created under a third electrode adjacent to the second electrode. The charge is then deposited onto the output diffusion capacitor.

In another embodiment, the input section comprises first and second pairs of switches coupled to first and second input signals, respectively. The other ends of each pair of switches are coupled to the first and second electrodes for metering charge onto the output diffusion capacitor in response to digital signals applied thereto. Capacitors are coupled to the first and second electrodes for maintaining the potentials applied thereto and, responsive to a digital signal, a switch couples the first and second electrodes.

BRIEF DESCRIPTION OF THE DRAWINGS

FIGS. 5 through 10 are illustrations of the potential wells created in various phases of the operation of the circuit of FIG. 1.

DESCRIPTION OF THE PREFERRED EMBODIMENT

Figure 1:
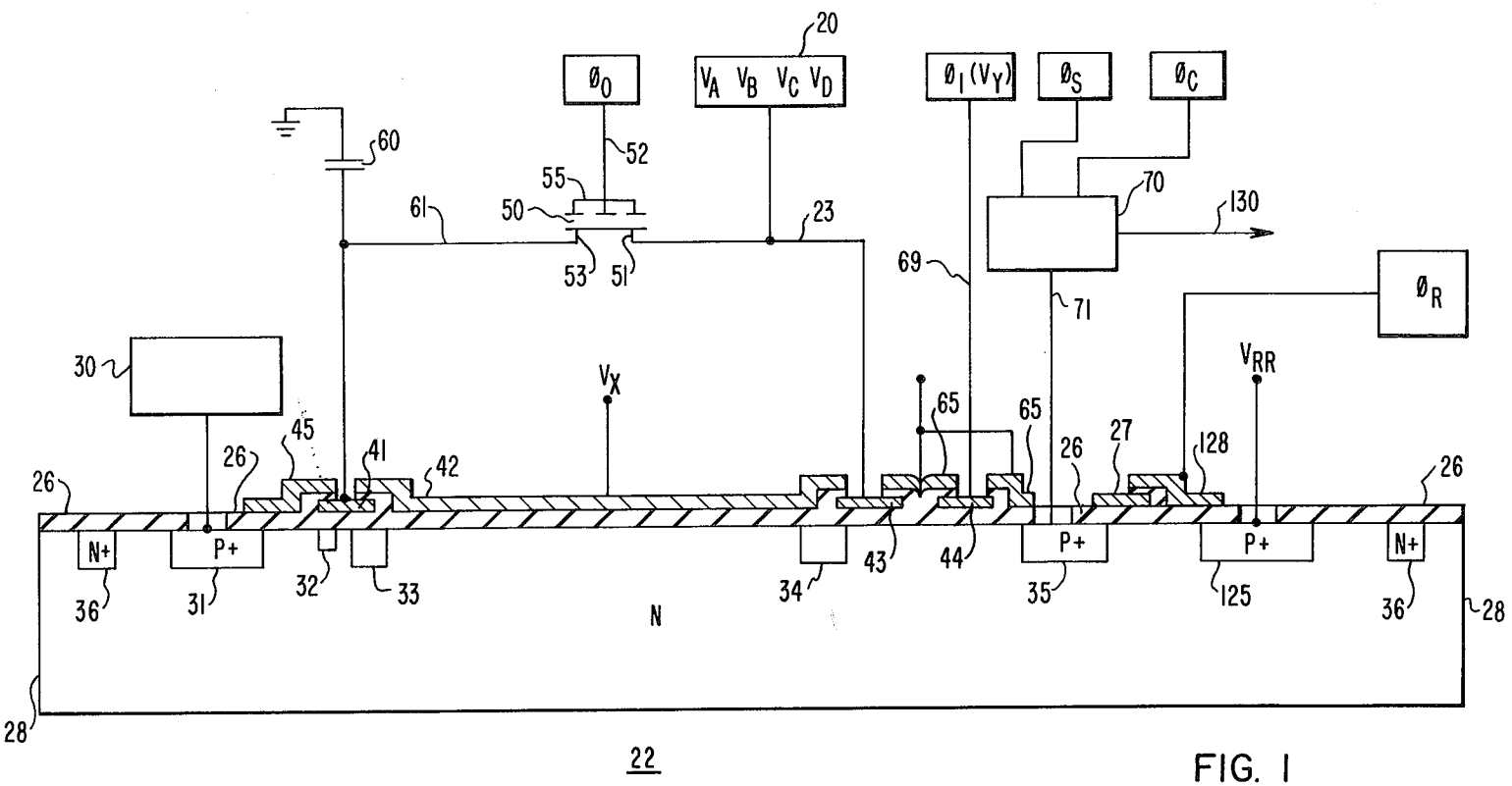
FIG. 1 is a circuit schematic diagram according to one embodiment of the present invention including an input circuit, a charge-coupled device, and an output circuit.

Referring now to the drawings wherein like reference characters designate corresponding parts throughout the several figures, FIG. 1 shows an embodiment of the CCD portion of the sequential processor of the present invention wherein a single-ended input means 20 is used to provide analog data samples in the form of voltage potentials to a charge-coupled device (CCD) 22. The CCD 22 comprises a layer of insulating material 26 formed on a substrate 28. Doped or diffused regions 31, 32, 33, 34, and 35, and N+ channel stop region 36 are formed in the substrate 28 and electrodes 41, 42, 43, 44 and 45 are formed on the insulating layer 26. The single-ended input 20 is coupled to the electrode 43 via a line segment 23, and is coupled to a metal-oxide semiconductor-field-effect transistor (MOSFET) switch 50 having a source 51, a gate 52 and a drain 53, which switch 50 is coupled between the gate electrodes 41 and 43 for selectively applying input voltage from the input means 20 to the gate 41. A capacitor 60 is coupled between the gate 41 and ground in order to maintain the potential of the voltage applied to the gate 41 via switch 50. MOSFET shields 65, and 55 are effective to decouple the digital pulses $\phi_1$ and $\phi_0$ applied to the gates 44 and 52, respectively, in order to minimize the electrical feedthrough or interaction between digital control signals on gates 44 and 52, respectively and analog signals applied to the gates 41 and 43.

The doped region 31 is an input diffusion region for injecting charge into the CCD 22. The doped region 32 is a doped region in the substrate 28 under the gate 41, which region 32 is responsive to a voltage applied to the gate 41 to create a potential barrier to charge injected into the CCD 22 by means of the diffusion region 31. The height of the barrier created by the region 32 is determined partly by the degree of doping in the region. The potential barrier may be created by other means. For example, a stepped oxide structure may be substituted for the region 32. The doped region 33 in the substrate 28 and spanning a volume beneath the electrodes 41 and 42, and the doped region 34 in the substrate 28 and spanning a volume beneath the electrodes 42 and 43 are of the same conductivity type as the diffusion region 31 and are effective to facilitate the flow of charge in the CCD 22. The doped region 35 is an output diffusion region of the same conductivity type as diffusion region 31 and conductive regions 33 and 34. Charge in the CCD 22 is removed via the output diffusion region 35.

The output diffusion region 35 is coupled to an output circuit 70 by a line 71, which output circuit 70 is effective to add and/or subtract charges removed from the CCD 22 via the output diffusion region 35 and to provide an output voltage indicative of an arithmetic function of the charges removed.

Figure 2:
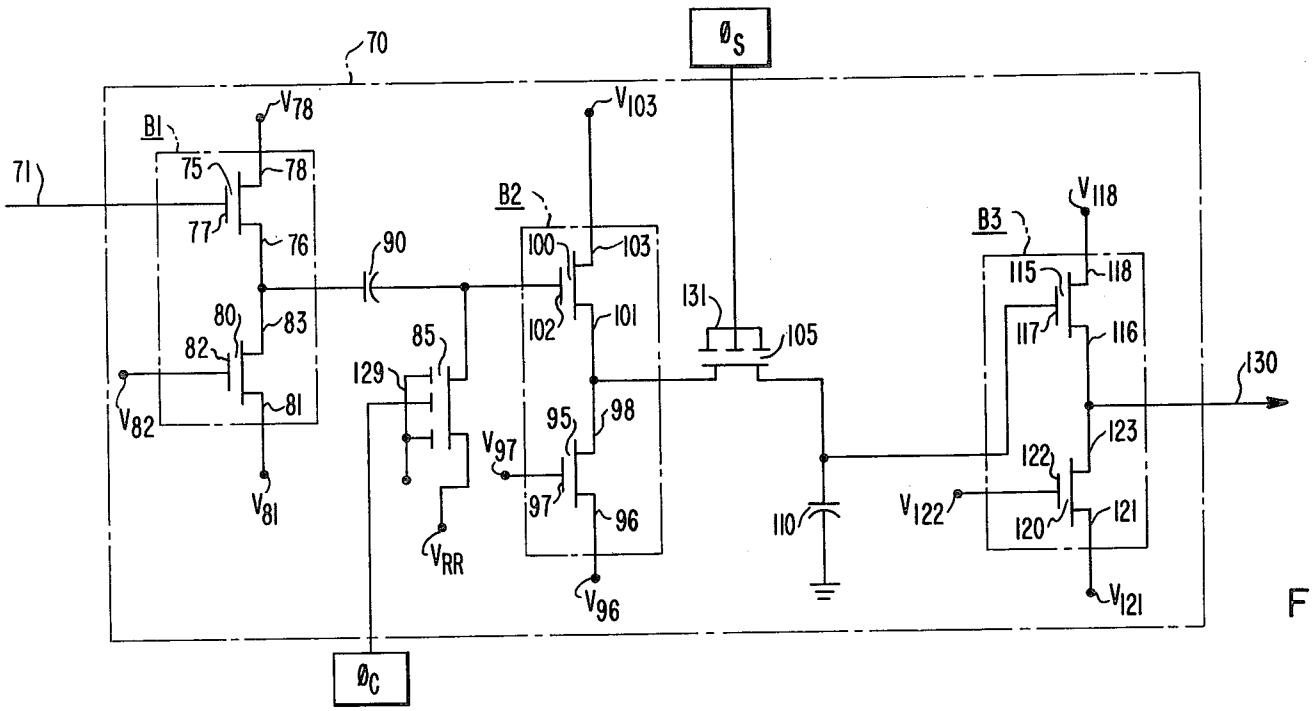
FIG. 2 is a schematic of the output circuit of FIG. 1.

The circuit 70 as shown in detail in FIG. 2 includes a buffer amplifier B1 which can be operated either as a source follower as shown or as an inverter. Buffer B1 comprises a MOS transistor 75 having a source 76, a gate 77, and a drain 78, and includes an MOS transistor 80 having a source 81, a gate 82, and a drain 83. The drain 83 and the source 76 are coupled together. Voltage potentials $V_{78}$, $V_{81}$, and $V_{82}$ are suitably adjusted such that the buffer B1 operates as a source-follower. When the buffer B1 is operated as an inverter, the sources and drains of transistors 75 and 80 are reversed. A clamp buffer B2 in a source-follower configuration comprises an MOS transistor 100 having a source 101, a gate 102, and a drain 103, and an MOS transistor 95 having a source 96, a gate 97, and a drain 98. Gate 102 is coupled to the source 76 of transistor 75 by a capacitor 90. Voltage potentials $V_{96}$, $V_{97}$, and $V_{103}$ are suitably adjusted such that the buffer B2 operates as a source-follower. When the buffer B2 is operated as an inverter, the sources and drains are reversed. The drain 98 is coupled to the source 101. An MOS switch 85 having a field shield 129 is coupled to the gate 102 of transistor 100. A sample/hold inverter buffer B3 which can operate either as a source-follower or as an inverter comprises an MOS transistor 115 having a source 116, a gate 117, and a drain 118, and an MOS transistor 120 having a source 121, a gate 122, and a drain 123. Transistor 120 serves as a load device. The drain 123 is coupled to the source 116. Voltage potentials $V_{118}$, $V_{121}$, and $V_{122}$ are suitably adjusted such that the buffer B3 operates as an inverter. An MOS switch 105 having a field shield 131 couples the source 101 of the transistor 100 to the gate 117 of the transistor 115. A capacitor 110 is coupled between the gate 117 and ground. An output voltage of the circuit 70 can be measured from the drain 116 via an output line 130.

Referring to FIG. 1, means including a reset gate 128 coupled to a digital control signal $\phi_R$ and a P+ diffusion diode 125 in the substrate 28 coupled to a reset reference potential $V_{RR}$ are provided for draining the charge in the CCD 22 so that another sequence of charges may be processed. A field shield 27 is positioned on the layer 26 and partially under the reset gate 128 for minimizing the electrical feedthrough between the digital control signal $\phi_R$ and the electrical charge passing therethrough. Coupled to the gate 44 is a digital pulse $\phi_1$ applied via line 69.

Figure 3:
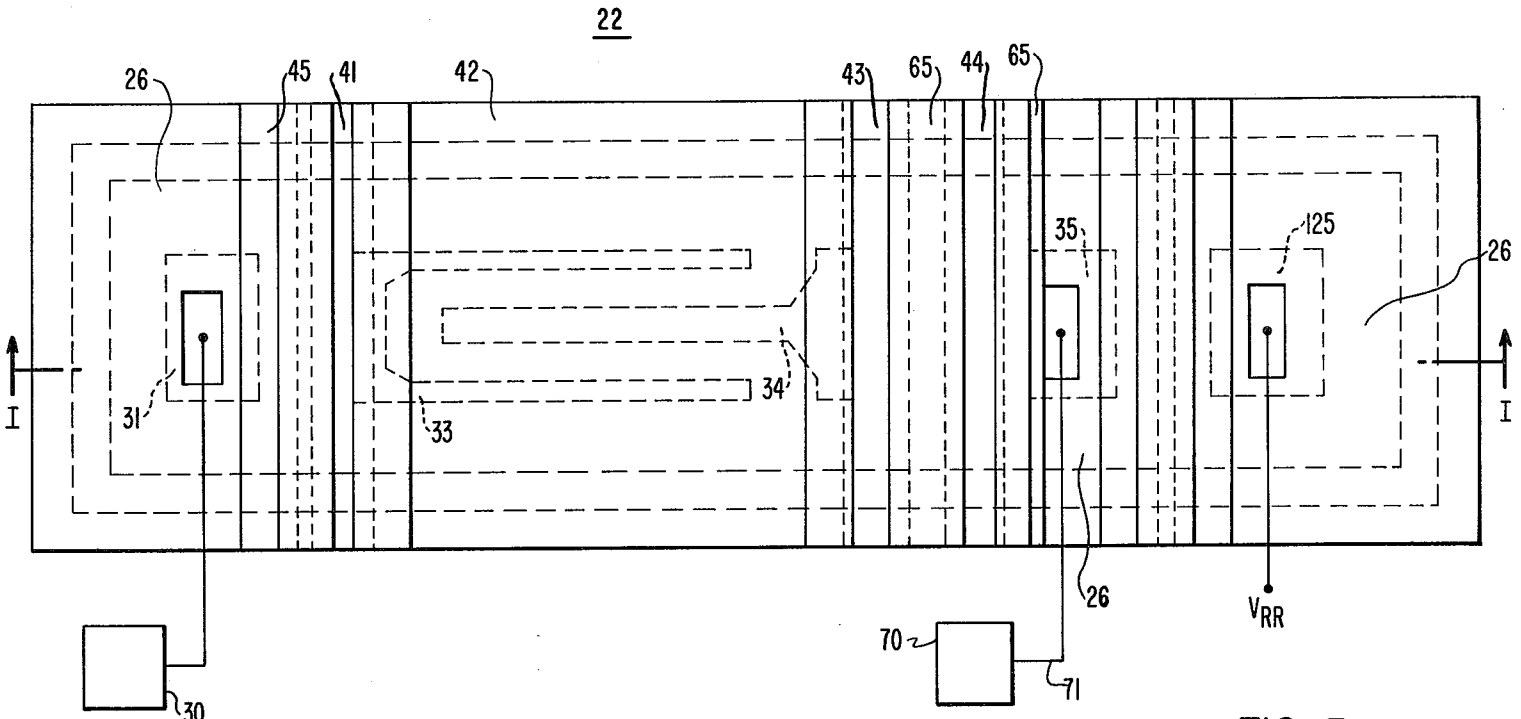
FIG. 3 is a top view of the CCD of FIG. 1.

FIG. 3 shows a top view of the CCD 22 including the electrodes situated thereupon. Diffusions into the substrate 28 are designated within dashed lines. Hatched lines are dashed where an electrode is beneath another electrode. FIG. 1 is a sectional view of the CCD 22 taken along the line I—I of FIG. 3.

Figure 4:
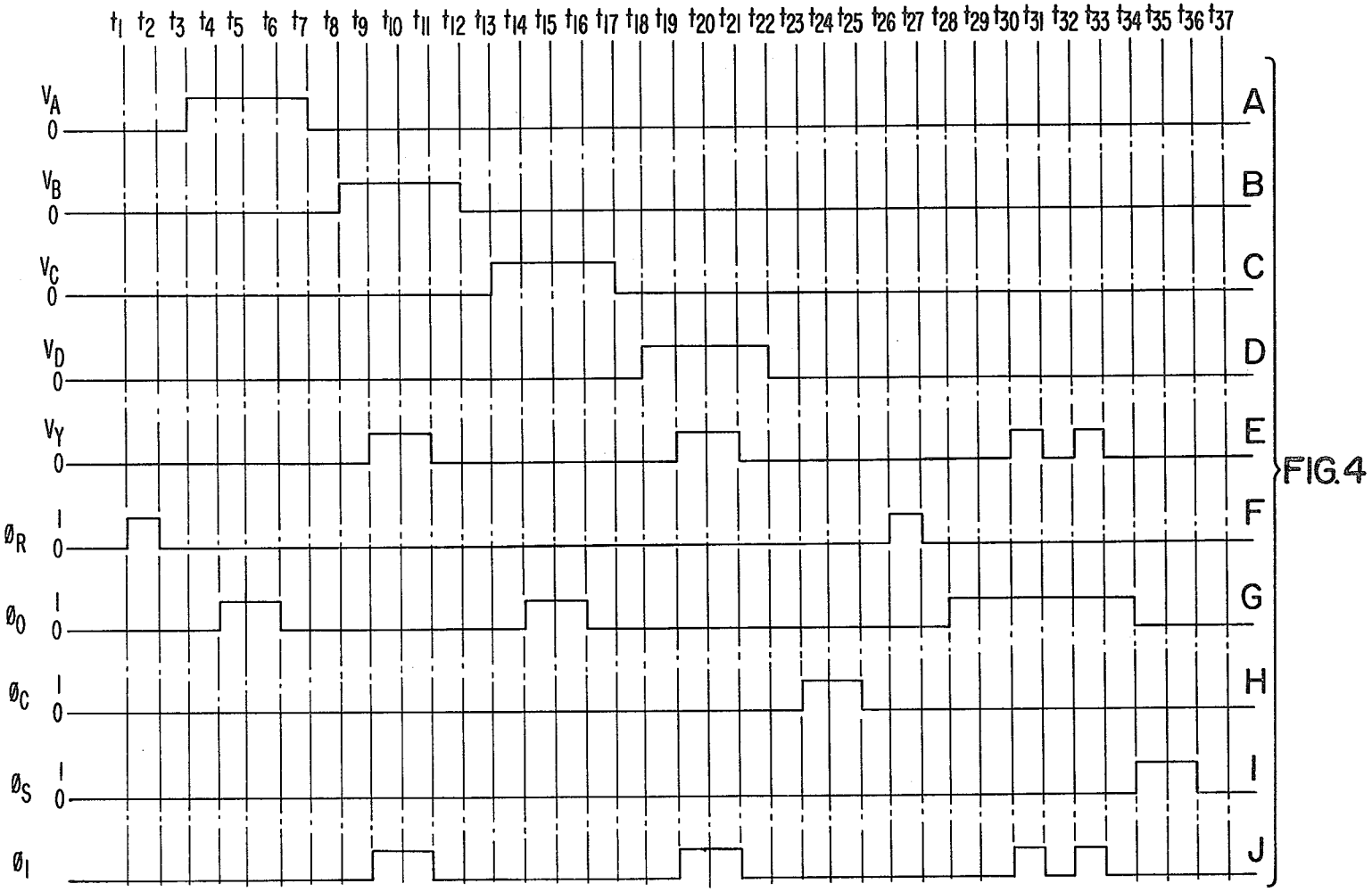
FIG. 4 is a set of timing diagrams according to the operation of the circuit of FIG. 1.

The operation of the device of FIG. 1 can be explained as follows with the aid of timing diagrams 4A through 4J. The waveforms in the timing diagrams 4A through 4J do not represent absolute timing requirements but only indicate the approximate relative position of apertures or transitions between signals. Initially, the CCD 22 is drained of any charge that may be contained therein by momentarily applying a digital pulse signal $\phi_R$ to the gate 128. This sequence is shown in the timing diagram $\phi_R$ of FIG. 4F at time $t_1$ and $t_2$. A voltage potential $V_A$ is applied by the input means 20 to the gate 43 and to source 51 of switch 50 via the line 23 as shown in FIG. 4A at time $t_3$. The switch 50 closes in response to a signal $\phi_0$ as shown in FIG. 4G at time $t_4$ charging the capacitor 60 to the potential $V_A$, which potential $V_A$ is also applied to the gate 41 via the line 61. A DC voltage potential $V_X$ is continuously applied to the gate 42 for creating thereunder a potential well in the substrate 28 corresponding to the potential $V_X$. FIG. 5 shows a potential well representation of the condition existing in the CCD 22 under the gates 41, 42, 43 and 44. The potential $V_A$ creates a well under the gate 43 having a potential proportional to the potential $V_A$. The potential $V_X$ on electrode 42 creates a well under the gate 42 having a potential proportional to the potential $V_X$. The built-in barrier 32 under the gate 41 has a potential ($V_A$-$V_Y$) due to the combined influence of the applied potential $V_A$ and a built-in potential barrier potential $V_Y$ created by the doped region 32 in FIG. 1.

A fill-spill technique is used to inject charge into the wells of the CCD 22 shown in FIG. 5 whereby a source of charge such as a pulse driver 30 shown in FIG. 1 coupled to the input diffusion diode 31 creates a first potential effective to inject electrical charge over the barrier under the gate 41 into the potential wells under the gate 42 and 43. Conventional commercial logic-to-MOS level shifters are illustrative examples of the pulse driver 30. The wells under the gates 41, 42 and 43 are effectively overfilled to cause a condition shown in FIG. 5 wherein a portion of the CCD 22 is filled with charge to a level slightly over the potential barrier under the gate 41. The level of charge is shown by the dashed line 139 and the charge is shown by the plus symbols 140. The pulse driver 30 then creates a second potential $V_Z$ greater than the potential barrier created under the electrode 41 for draining off the excess charge-filled wells of the CCD 22 so that the charge therein is at the level of the potential barrier under the electrode 41. This condition is illustrated in FIG. 6 wherein the charge 140 is contained in potential wells under the electrodes 42 and 43 at a level shown by the dashed line 142.

Next, the signal $\phi_0$ is removed as shown in FIG. 4G at time $t_6$ and the switch 50 opens. A new voltage potential $V_B$ at $t_8$ is applied by the input means 20 to the gate 43 via the line 23 after the potential $V_A$ is removed at $t_7$ so that the gate 41 is maintained at the potential $V_A$ by the capacitor 60 while the gate 43 is at the potential $V_B$ maintained thereat by the input means 20 and line 23.

A voltage potential $V_Y$ is applied to the gate 44 as shown in timing diagram 4E at time $t_9$ in response to a digital control signal $\phi_1$ as shown in timing diagram 4J at time $t_9$ so that a well is created thereunder having a potential proportional to the potential $V_Y$.

FIG. 7 illustrates the new potential well created under the gate 43 having a potential corresponding to the potential $V_B$ applied to the gate 43 and the well created under the gate 44 having a potential corresponding to the potential $V_Y$ applied to the gate 44. FIG. 7 shows an instantaneous view (transient condition) of the charge 140 moving in the CCD 22 after the voltage potentials $V_B$ and $V_Y$ have been applied to the gates 43 and 44, respectively. The well under the gate 43 presents a potential barrier to some of the charge 140 contained in the well under gate 42; the barrier created under gate 43 prevents a portion of the charge 140 from flowing into the well created under the gate 44. An amount of charge 146 which is a portion of charge 140 in the CCD 22 that is above the level of the potential well under the gate 43 will flow into the well created under the gate 44.

Figure 8:
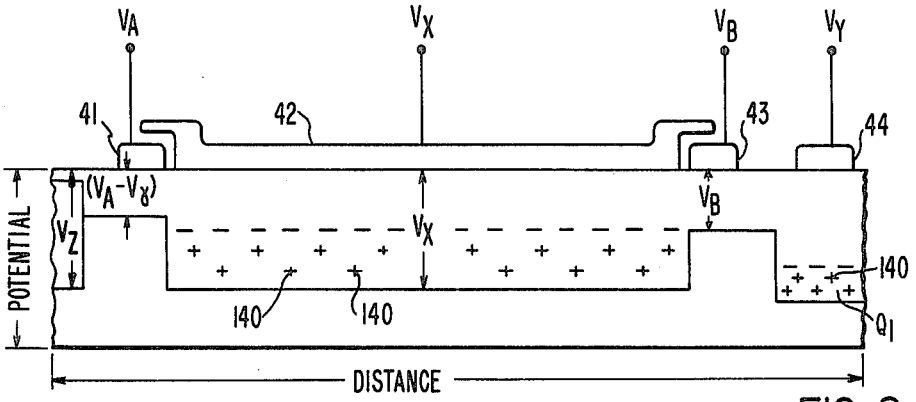

FIG. 8 shows an equilibrium condition of the charge 140 in CCD 22. The excess charge 146 in the CCD 22, the charge that was above the level of $V_B$, flows into the well under the gate 44. This excess charge 146 in the well under the gate 44 is proportional to a charge $Q_1$ where $$Q_1 = C_{in}\,]V_a - (V_B - V_A)]$$

$$Q_1 = Q^* + C_{in}(V_A - V_B) \qquad (1)$$

where $Q^* = V_a C_{in}$, and $C_{in}$ = the effective input capacitance. The charge $Q_1$ is stored on the capacitor existing at the output diffusion diode 35.

A third voltage potential $V_C$ at $t_{13}$ is applied via the input means 20 to the gate 43 and to the switch 50 via the line 23 as in the case of the voltage potential $V_A$ hereinbefore discussed. The application of the potential $V_C$ is represented by the timing diagram $\phi_0$ of FIG. 4G at a time $t_{14}$. The signal $\phi_0$ activates causing the switch 50 to close, charging the capacitor 60 to the potential $V_C$, which potential $V_C$ is also applied to the gate 41 via the line 61.

Figure 9:
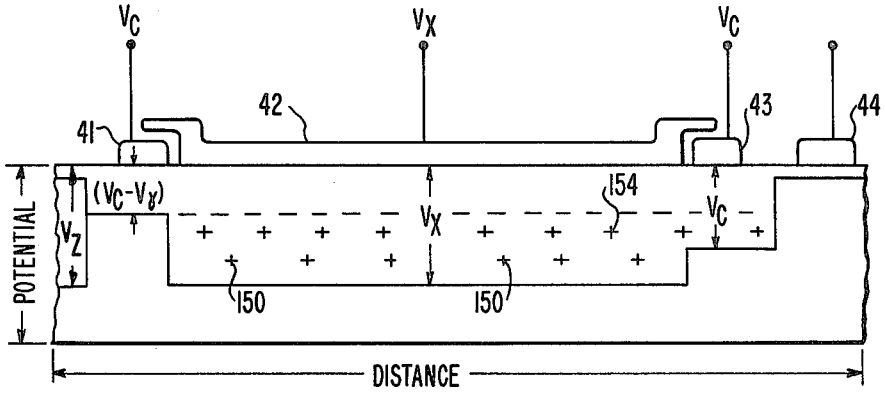

FIG. 9 shows a potential well representation of the conditions existing in the CCD under the gates 41, 42, 43 and 44 after time $t_{14}$. The potential well representations shown in FIG. 9 are similar to the potential well representations explained with reference to FIG. 5.

Figure 10:
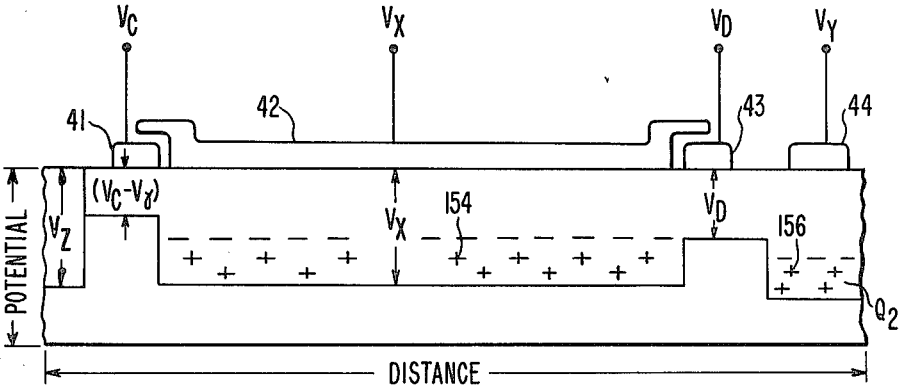

Next, the signal $\phi_0$ is disabled as shown in FIG. 4G at time $t_{16}$ and the switch 50 opens. A fourth voltage potential $V_D$ is applied at $t_{18}$ by the input means 20 to the gate 43 via the line 23 after the potential $V_C$ is removed at $t_{17}$ so that the gate 41 is maintained at the potential $V_C$ by the capacitor 60 while the gate 43 is at the potential $V_D$. This sequence is shown in FIGS. 4C and 4D at times $t_{17}$ and $t_{18}$. The potential $V_Y$ is applied to the gate 44 in response to the digital control signal $\phi_1$ as shown, respectively, in timing diagrams 4E and 4J at times $t_{19}$ for creating a potential well thereunder as hereinbefore explained. The fill-spill technique discussed hereinbefore with reference to FIGS. 5, 6, 7, and 8 is used to move electrical charge corresponding to the potential ($V_C - V_D$) into the charge metering wells of the CCD 22 of FIG. 1, as hereinbefore explained with reference to the potential $V_A$ and $V_B$; and a quantity of charge $Q_2$, where:

$$Q_2 \alpha Q^* + C_{in}(V_C - V_D) \quad (2)$$

is metered into a well created under the gate 44 as shown in FIG. 10 by the plus symbols 156 and as hereinbefore explained with reference to the potentials $V_A$ and $V_B$ and illustrated by the FIGS. 6, 7 and 8. The charge $Q_2$ is added to the charge $Q_1$ stored on the capacitor at the output diffusion diode 35 to give a total charge:

$$Q_T = Q_1 + Q_2 \alpha 2Q^* + C_{in}(V_A - V_B + V_C - V_D) \quad (3)$$

The MOS clamp switch 85 in FIG. 2 closes in response to the pulse signal $\phi_C$ as shown in FIG. 4H at time $t_{23}$ in order to couple the difference capacitor 90, heretofore floating, to AC ground through the DC biasing voltage potential $V_{RR}$ and thereby store a voltage across the difference capacitor 90 corresponding to the charge $Q_T$. The switch 85 opens in response to the removal of the pulse signal $\phi_C$ at time $t_{25}$. The charge $Q_T$ in the outputdiffusion 35 is drained or removed therefrom through the P+ diffusion 125 in response to the digital control signal $\phi_R$ at times $t_{26}$ and $t_{27}$.

At time $t_{28}$, the capacitor 90 is floating with a voltage $V_T$ thereacross indicative of the charge $Q_T$, and the output diffusion diode capacitor at 35 contains zero signal charge. Since the capacitor 90 is floating, every succeeding potential appearing at the drain 83 of the transistor 80 has subtracted from it the potential then appearing across the capacitor 90, nanely $V_T$, where:

$$V_T \alpha 2Q^* + C_{in}(V_A - V_B + V_C - V_D) \quad (4)$$

It is desirable to eliminate the 2Q* component in the capacitor 90 in order to achieve a signal indicative of only the actual analog signal components $V_A$, $V_B$, $V_C$ and $V_D$. The desired potential $V_{T0}$ at the gate 102 is of the relationship:

$$V_{T0} \alpha C_{in}(V_A - V_B + V_C - V_D) \quad (5)$$

in order to achieve the relationship of equation (5) in view of the existing potential $V_T$ across the capacitor 90, the following steps are taken. The signal $\phi_0$ is activated, closing the switch 50 and thereby applying whatever potential exists on the line 23 to the gates 41 and 43 and the capacitor 60. The specific potential applied to the two gates 41 and 43 is unimportant so long as the potentials there-applied are substantially equal and fall in the usual range for signals $V_A$, $V_B$, $V_C$, and $V_D$. The metering operation discussed hereinbefore with reference to the FIGS. 5 through 10 is performed two times, i.e. the fill-spill technique shown, for example, in FIGS. 5 through 8 is used to fill the wells under gates 42 and 43 with charge and the signal charge difference is metered into a well formed under the gate 44 as shown, for example, in FIGS. 5 through 8. Each time the metering operation is performed, a charge indicative of Q* is metered onto the output diffusion capacitor giving a total charge of 2Q* metered in the two times that the operation is performed. The charge 2Q* is stored on the output diffusion diode 35 capacitor and a potential 2V* indicative thereof appears at the output 81 of the buffer B1 as hereinbefore explained. Since the capacitor 90 is floating, the potential 2V* has subtracted from it the potential existing thereacross, namely $V_T \alpha 2Q^* + C_{in}(V_A - V_B + V_C - V_D)$, to give the desired potential $V_{T0}$ according to equation (5).

The switch 105 closes in response to the pulse $\phi_S$ thereby causing the potential $V_{T0}$ to be impressed across the capacitor 110 through the buffer B2. The potential $V_{T0}$ can be sampled on the output line 130 through the buffer B3. The buffer B1 is effective to provide a low impedance drive for the capacitor 90 in order to facilitate impressing the voltage $V_{T0}$ thereacross. The buffer B2 provides a high impedance to the capacitor 90 for preventing or minimizing the leakage of current or charge therefrom. Likewise, the low impedance needed in order to facilitate the impressing of the potential $V_{T0}$ across the capacitor 110 is provided by the output 101 of the buffer B2 and the high impedance needed to prevent the leaking of charge therefrom is provided by the input or gate 117 of the buffer B3.

Figure 11:
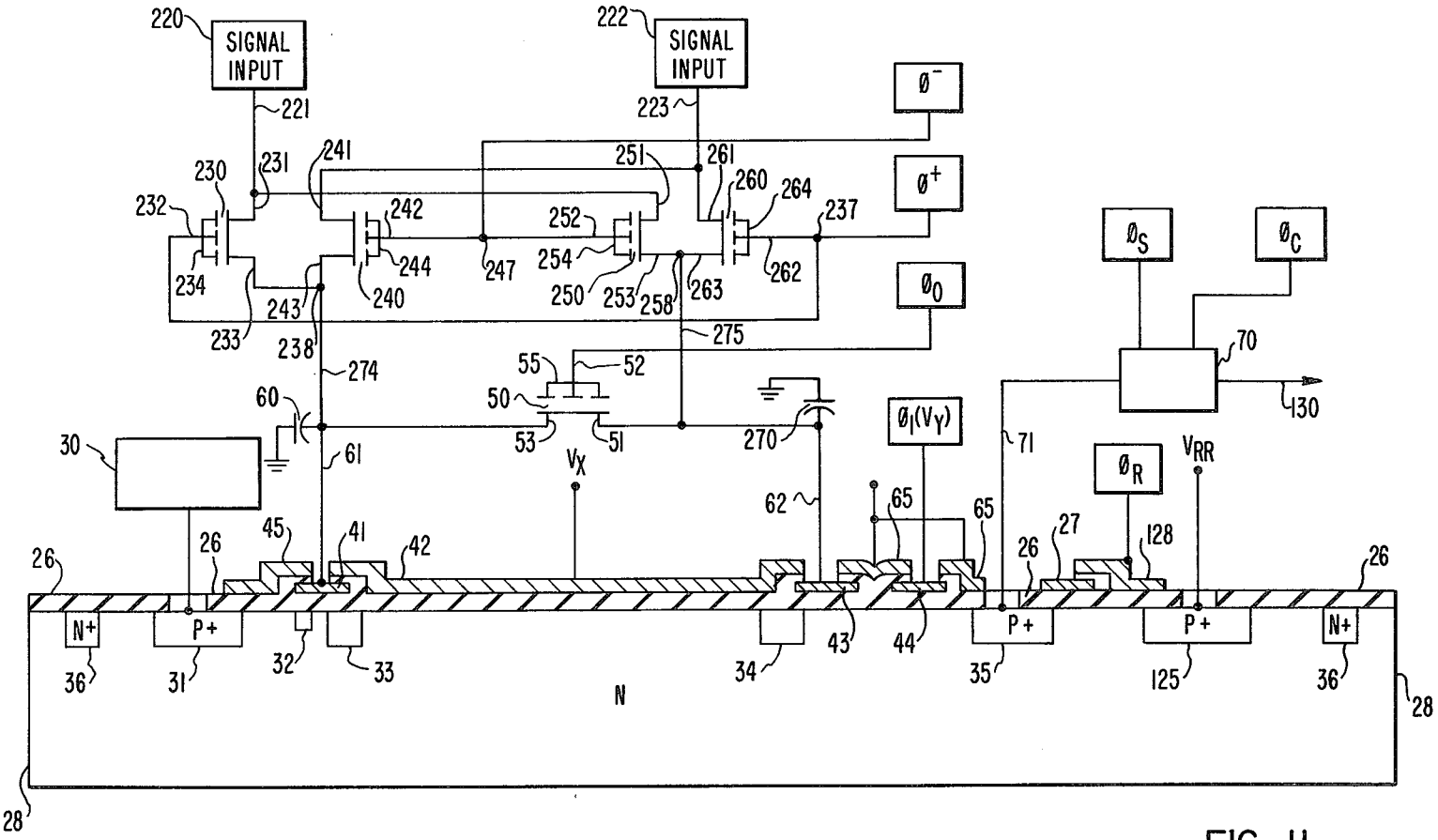
FIG. 11 is a circuit schematic diagram according to another embodiment of the present invention.

Another embodiment of the present invention is shown in FIG. 11 which includes some of the circuitry of FIG. 1, for example, the CCD 22, the circuit 70, the MOS shield 65, the MOS transistor switch 50 and the shield 55, the capacitor 60, and the pulse driver 30 to provide a charge source. In addition, the embodiment of the present invention shown in FIG. 11 includes nominally balanced signal inputs including a first input voltage input 222 and a second input voltage 220. The additional circuitry of FIG. 11 also includes an MOS transistor switch 230 having a source 231, a gate 232, an electrostatic field shield 234, and a drain 233; an MOS transistor switch 240 having a source 241, a gate 242, an electrostatic field-shield 244, and a drain 243; an MOS transistor switch 250 having a source 251, a gate 252, an electrostatic field-shield 254, and a drain 253; and an MOS transistor switch 260 having a source 261, a gate 262, an electrostatic field-shield 264, and a drain 263. The transistors 230 and 250 are coupled in parallel to the second input voltage input 220 by a line 221 by coupling the sources 231 and 251 to the line 221. The transistors 240 and 260 are coupled in parallel to the first input voltage input 222 by a line 223 by coupling the sources 241 and 261 to the line 223. The transistors 230 and 260 are coupled to each other by coupling the gates 232 and 262 and the transistors 240 and 250 are coupled together by coupling the gates 242 and 252. The transistors 230 and 240 are coupled together by coupling the drains 233 and 243 and the transistors 250 and 260 are coupled together by coupling the drains 253 and 263.

A digital pulse signal $\phi^-$ is coupled to the gates 242 and 252 at a node 247 and a digital pulse signal $\phi^+$ is coupled to the gates 232 and 262 at a node 237. The gate 41 is coupled to the drains 233 and 243 via the line 61 and a line 274 at a node 238. The gate 43 is coupled to one side of capacitor 270, the drains 253 and 263 via the line 62 and a line 275 at a node 258. The other side of capacitor 270 is coupled to ground.

The operation of the balanced embodiment of the present invention shown in FIG. 11 similar to the single-ended embodiment shown in FIG. 1 and is explained with the aid of the timing diagrams 12A through 12O. Any charge in the output diffusion diode 35 is drained by applying the digital pulse signal $\phi_R$ to the gate 128 of CCD 22 as shown in FIG. 12L at times $t_1$ and $t_2$, thereby coupling charge from diode 35 to diffusion 125 and draining out the charge.

Next, as shown at times $t_4$ through $t_8$ in FIGS. 12A and 12B, signal voltage potentials $V_A+$ and $V_A-$ are applied to the lines 221 and 223, respectively, by the inputs 220 and 222, respectively. Then, the switches 230 and 260 close in response to application of a pulse from $\phi^+$, as shown in FIG. 12I at time $t_5$, thereby applying the potentials $V_A^+$ and $V_A^-$ to the gates 41 and 43, respectively, and charging the capacitors 60 and 270 to the potentials $V_A^+$ and $V_A^-$, respectively. The switches 230 and 260 open in response to the removal of the signal $\phi^+$ at time $t_7$ as shown in FIG. 12I, and the potentials $V_A^+$ and $V_A^-$ are removed from the lines 221 and 223, respectively at time $t_8$. The fill-spill technique discussed hereinbefore with reference to the potential $V_A$ and FIGS. 5 through 8 and the metering technique discussed hereinbefore with reference to the potentials $V_A$, $V_B$ and $V_Y$ and FIGS. 6, 7 and 8 is used here to meter charge onto the output diffusion diode 35. The charge $Q_{11}$ metered thereon can be given by:

$$Q_{11} \alpha Q^* + C_{in}((V_A^+) + \Delta - (V_A^-)) \quad (6)$$

where $\Delta$ = the effective input offset voltage.

Figure 12:
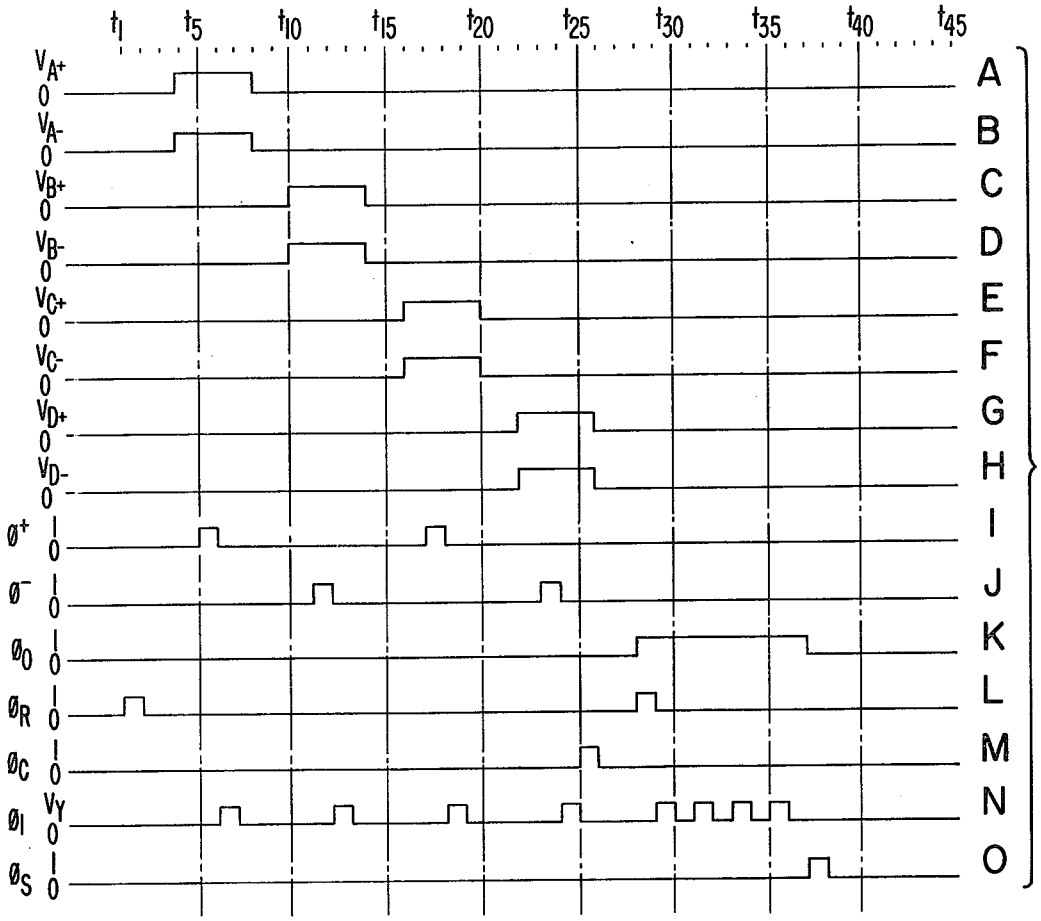
FIG. 12 is a set of timing diagrams according to the operation of the circuit of FIG. 11.

Next, the inputs 220 and 222 apply signal potentials $V_B^-$ and $V_B^+$ on the lines 221 and 223, respectively as shown in FIGS. 12C and 12D at times $t_{10}$. Then, the switches 240 and 250 close in response to the signal $\phi^-$, as shown at time $t_{11}$ in FIG. 12, thereby applying the potentials $V_B^-$ and $V_B^+$, respectively, in order to maintain the gates 41 and 43 at their respective potentials when the switches 240 and 250 open in response to removal of the signal $\phi^-$ at time $t_{12}$. The type of potentials applied to the gates 41 and 43 are reversed from the type of potentials applied thereto with reference to the potentials $V_A^+$ and $V_A^-$, i.e., the potentials $V_A^+$ and $V_A^-$ were applied to the gates 41 and 43, respectively, while the potentials $V_B^-$ and $V_B^+$ are applied to the gates 41 and 43, respectively.

The fill-spill and metering techniques hereinbefore discussed can be used to meter charge onto the output diffusion diode 35 i.e., the potential $V_Y$ is applied to the gate 44 in response to the digital signal $\phi_1$ and creates under the gate 44 a depletion region or channel equivalent to a conduit through which a charge $Q_{12}$ is metered onto the output diffusion diode 35. The limit of the speed at which the device can operate is determined in part by the speed at which the charge $Q_{12}$ can completely pass through the channel under the gate 44. If the potential $V_Y$ is removed prematurely, some charge will remain and this remaining charge will "back-fill" into the holding well under the gate 42. The charge $Q_{12}$ metered thereon can be expressed as:

$$Q_{12} \alpha Q^* + C_{in}((V_B^-) - \Delta - (V_B^+)) \quad (7)$$

Two potentials $V_C^+$ and $V_C^-$ are applied to the lines 221 and 223 as shown in FIGS. 12E and 12F at times $t_{16}$ through $t_{20}$ in a manner similar to that explained with reference to the potentials $V_A^+$ and $V_A^-$ to cause a charge $Q_{13}$ to be metered onto the output diffusion diode 35 MOS where:

$$Q_{13} \alpha Q^+ + C_{in}((V_C^+) + \Delta - (V_C^-)) \quad (8)$$

Two potentials $V_D^-$ and $V_D^+$ are applied to the lines 221 and 223 as shown at times $t_{22}$ through $t_{26}$ in FIGS. 12G and 12H in a manner similar to that discussed with reference to the potentials $V_B^-$ and $V_B^+$ to cause a charge $Q_{14}$ to be metered onto the output diffusion diode 35 MOS capacitor where:

$$Q_{14} \alpha Q^* + C_{in}((V_D^-) - \Delta - (V_D^+)) \quad (9)$$

The charge $Q_{TT}$ on the output diffusion diode 35 at the end of the sequence potentials $V_A^+$ and $V_A^-$, and $V_B^+$ and $V_B^-$, $V_C^+$ and $V_C^-$ and $V_D^+$ and $V_D^-$ is $$Q_{TT} \alpha 4Q^* + (\delta A - \delta B + \delta C - \delta D) \quad (10)$$

$$\text{where } \delta A = (V_A^+ - V_A^-) \quad (11)$$

$$\delta B = (V_B^+ - V_B^-) \quad (12)$$

$$\delta C = (V_C^+ - V_C^-) \quad (13)$$

$$\delta D = (V_D^+ - V_D^-) \quad (14)$$

The switch 85, shown in FIG. 2, closes in response to the signal $\phi_C$ as shown in FIG. 12M at time $t_{28}$ in order to charge the capacitor 90 to a potential $V_{TT}$ indicative of the charge $Q_{TT}$ in a manner similar to that discussed with reference to the charge $Q_T$ and FIG. 1. The output diffusion diode 35 is drained of the charge $Q_{TT}$ in response to a signal $\phi_R$ as shown in FIG. 12L at time $t_{28}$ in a manner similar to that discussed with reference to the charge $Q_T$ in FIG. 1. At time $t_{29}$, the capacitor 90 is floating having a voltage $V_{TT}$ thereacross indicative of the charge $Q_{TT}$, the output diffusion diode 35 contains no charge. Since the capacitor 90 is floating, the potential appearing thereacross, namely $V_{TT}$, where:

$$V_{TT} \alpha 4Q^* + C_{in}(\delta A - \delta B + \delta C - \delta D) \quad (15)$$

will be subtracted from each succeeding potential existing on the output 83 of the buffer B1.

For reasons stated hereinbefore with respect to eliminating the 2Q* component of equation (4), it is desirable to eliminate the 4Q* component in the equation (15). In a manner similar to that discussed hereinbefore with reference to eliminating the 2Q* component in the operation of the single-ended embodiment of FIG. 1 and equations (4) and (5), the 4Q* component of equation (15) is eliminated. The signal $\phi_0$ is activated, as shown in FIG. 12K at time $t_{28}$, closing the switch 50 and thereby causing the potentials applied to the gates 41 and 43 to equalize as the potentials across the capacitors 60 and 270 equilibrate to some average value. The specific potentials applied to the two gates 41 and 43 is insignificant so long as the potentials there-applied are substantially equal. The metering operation discussed hereinbefore with reference to FIGS. 5 through 8 is performed four times from time $t_{34}$ through time $t_{41}$ in a manner similar to that discussed hereinbefore with reference to eliminating the 2Q* component in the capacitor 90 in the single-ended input configuration of FIG. 1. Each time the metering operation is performed, a charge indicative of Q* is metered, giving a total of 4Q* for the four times that the operation is performed. The charge 4Q* is stored on the output diffusion diode 35 and a potential 4V* indicative thereof appears at the output 81 of the buffer B1 shown in FIG. 2 as hereinbefore explained. Since the capacitor 90 is floating, the potential existing thereacross, namely, $V_{TT} \alpha 4Q^* + C_{in}(-\delta A - \delta B + \delta C - \delta D)4V^* + C_{in}(\delta A - \delta B + \delta C - \delta D)$ is subtracted from the potential 4V* to provide a desired potential $V_{TT0}$ where:

$$V_{TT0} \alpha C_{in}(\delta A - \delta B + \delta C - \delta D) \quad (16)$$

An output signal is provided in a manner similar to that hereinbefore discussed with reference to the single-ended input embodiment of FIG. 1. The switch 105 closes in response to the pulse $\phi_S$ at a time $t_{37}$ in order to provide an output signal on the output line 130 of the circuit 70 indicative of the potential $V_{TTO}$.

What I claim is:

1. A charge-coupled circuit for metering electrical charge comprising:

(a) input means including first switching means for providing a sequence of voltage potentials;

(b) charge-coupled means coupled to said input means for providing charge indicative of said sequence of potentials; and (c) circuit means coupled to said charge-coupled means including potential converting means for providing and storing a signal indicative of said charge provided by said charge-coupled means, output means coupled to said potential converting means including second switching means for providing in response to a switching signal, an output signal indicative of the signal provided by said potential converting means, and discharge means for removing charge in said charge-coupled means at predetermined times;

said potential converting means including a capacitor, buffer means coupled between said charge-coupled means and said capacitor for providing a drive of appropriate impedance for charging said capacitor, and grounding means responsive to a control signal for coupling one side of said capacitor to ground.

2. A charge-coupled circuit according to claim 1 wherein said charge-coupled means includes:

(a) means for supplying a source of electrical charge;

(b) a charge-coupled device (CCD) having a substrate, said substrate having an insulating layer formed thereupon and input and output diffusion regions formed therein, a capacitive region including said output diffusion region, said input diffusion region coupled to said means for supplying a source of electrical charge, said output diffusion region coupled to said circuit means;

(c) input well-forming means for forming in said substrate, in response to a first predetermined voltage potential condition, at least one potential well;

(d) output well-forming means responsive to a second predetermined voltage potential condition for forming an output well in said substrate; and means for transferring a portion of charge in said input well-forming means into said output potential well;

(e) means for transferring charge in said output potential well to said capacitive region.

3. A charge-coupled circuit according to claim 2 wherein said means for supplying a source of electrical charge includes a switching circuit coupled to said input diffusion.

4. A charge-coupled circuit according to claim 2 wherein said input well-forming means include first, second and third potential well-forming means for forming, in response to a voltage potential applied thereto, first, second and third potential wells, respectively, in said substrate:

said first well-forming means including a first electrode on said insulating layer adjacent said input diffusion region;

said second well-forming means including a second electrode on said insulating layer adjacent said first electrode; and said third well-forming means including a third electrode on said insulating layer adjacent said second electrode.

5. A charge-coupled circuit according to claim 2 wherein:

said output well-forming means includes an electrode on said insulating layer adjacent said output diffusion region.

6. A charge-coupled circuit according to claim 2 wherein said charge-coupled device further includes means in said substrate and adjacent to said input diffusion region for forming a potential barrier to charge injected into said charge-coupled device.

7. A charge-coupled circuit according to claim 6 wherein said potential barrier is formed by ion implantation.

8. A charge-coupled circuit according to claim 6 wherein said potential barrier is formed by stepped dielectric.

9. A charge-coupled circuit according to claim 4 wherein said charge-coupled device further includes conductive regions in said substrate under said first, second and third electrodes.

10. A charge-coupled circuit according to claim 2 wherein said first switching means of said input means includes:

(a) a first switch for applying certain ones of said sequence of voltage potentials to said first potential well-forming means;

(b) holding means for maintaining said first potential well-forming means at the potential of a voltage from said sequence of voltage potentials applied thereto through via said first switching means; and (c) means for applying said sequence of voltage potentials to said third potential well-forming means.

11. A charge-coupled circuit according to claim 10 wherein said first switch includes a metal-oxide-semiconductor transistor.

12. A charge-coupled circuit according to claim 10 wherein said holding means includes a capacitor.

13. A charge-coupled circuit according to claim 4 wherein said input means includes:

a conversion means for supplying first and second input voltage each corresponding to an input signal;

controllable switch means for selectively coupling said first input voltage and said second input voltage to said first electrode and said third electrode;

means for maintaining said first electrode at a voltage potential applied thereto;

means for maintaining said second electrode at a voltage potential applied thereto; and switch means for coupling said first and second gates together.

14. A charge-coupled circuit according to claim 13 wherein said controllable switch means includes:

a first switch circuit for coupling said first input voltage to said first and third gates;

a second switch circuit for coupling said second input voltage to said first and third gates; and control means for operating said first and second switch circuits.

15. A charge-coupled circuit according to claim 14 wherein:

said first switch circuit includes first and second switches for coupling said first input voltage to said first and third gates, respectively.

16. A charge-coupled circuit according to claim 14 wherein:

said second switch circuit includes third and fourth switches for coupling said second input voltages to said first and third gates, respectively.

17. A charge-coupled circuit according to claim 14 wherein:

said control means includes a first control line for simultaneously operating said first and fourth switches.

18. A charge-coupled circuit according to claim 14 wherein:

said control means includes a second control line for simultaneously operating said second and third switches.

19. A charge-coupled circuit according to claim 1 wherein the buffer means of said potential converting means includes:

first and second metal-oxide semiconductor transistors each having a source, a gate, and a drain, the gate of said first transistor coupled to said charge-coupled means and to the discharge means of said circuit means, and the source of said first transistor and the drain of said second transistor are coupled to each other and to said capacitor.

20. A charge-coupled circuit according to claim 1 wherein said grounding means includes a third switching means.

21. A charge-coupled circuit according to claim 20 wherein said third switching means includes a metal-oxide semiconductor transistor switch having a gate, a source, and drain having an electrostatic field shield for electrically isolating control signals applied to said gate from analog signals passing through said transistor.

22. A charge-coupled circuit for metering electrical charge, said charge-coupled circuit comprising:

(a) input means including first switching means for providing a sequence of voltage potentials;

(b) charge-coupled means coupled to said input means for providing charge indicative of said sequence of potentials; and (c) circuit means coupled to said charge-coupled means including potential converting means for providing and storing a signal indicative of said charge provided by said charge-coupled means, output means coupled to said potential converting means including second switching means for providing in response to a switching signal, an output signal indicative of the signal provided by said potential converting means, and discharge means for removing charge in said charge-coupled means at predetermined times;

the output means of said circuit means including:

a capacitor coupled to said second switching means and to ground;

an output line;

a first buffer means coupled between said potential converting means and said second switching means for providing a low impedance drive for said capacitor in order to facilitate the impressing of a potential voltage thereacross and for providing a high impedance to said potential converting means;

a second buffer means coupled between said capacitor and said output line for providing a high impedance to said capacitor.

23. A charge-coupled circuit according to claim 22 wherein said second switching means includes:

a metal-oxide semiconductor transistor switch having a gate, a source, and a drain, and having an electrical shield for electrically isolating control signals applied to said gate from analog signals passing through said transistors.

24. A charge-coupled circuit according to claim 22 wherein the first buffer of the output means of said circuit means includes:

first and second metal-oxide semiconductor transistors each having a source, a drain, and a gate, the gate of said first transistor is coupled to said potential converting means, and the source of said first transistor and the drain of said second transistor are coupled together and to said second switching means; and the second buffer of the output means of said circuit means includes:

third and fourth metal-oxide semiconductor transistors each having a source, a drain, and a gate, the gate of said first transistor is coupled to said capacitor, and the source of said first transistor and the drain of said second transistor are coupled to each other and to said output line.

25. A charge-coupled circuit for metering electrical charge comprising:

(a) input means including first switching means for providing a sequence of voltage potentials;

(b) charge-coupled means coupled to said input means for providing charge indicative of said sequence of potentials; and (c) circuit means coupled to said charge-coupled means including potential converting means for providing and storing a signal indicative of said charge provided by said charge-coupled means, output means coupled to said potential converting means including second switching means for providing in response to a switching signal, an output signal indicative of the signal provided by said potential converting means, and discharge means for removing charge in said charge-coupled means at predetermined times;

the discharge means of said circuit means including a metal-oxide semiconductor transistor having a source, a gate, and a drain, and having an electrostatic field shield for electrically isolating control signals applied to said gate from analog signals passing through said transistor, said source coupled to the output diffusion region of said charge-coupled means.

26. A charge-coupled circuit for metering electrical charge comprising:

(a) charge-coupled means for providing charge indicative of a sequence of potentials, said charge-coupled means including:

(1) means for supplying a source of electrical charge;

(2) a charge-coupled device (CCD) having a substrate, said substrate having an insulating layer formed thereupon and an input diffusion region formed therein, said input diffusion region coupled to said means for supplying a source of electrical charge;

(3) input well-forming means for forming, in response to a voltage potential applied thereto, at least one potential well in said substrate;

(b) input means including first switching means for providing said sequence of voltage potentials, said input means including:

(1) a first switch means for applying certain ones of said voltage potentials to said first potential input well-forming means;

(2) means for maintaining said first potential well-forming means at the potential of a voltage applied thereto via said switch means; and (3) means for applying said voltage potentials to said third potential well-forming means.

27. A charge-coupled circuit according to claim 26 further including fourth well-forming means responsive to a voltage potential for forming an output well in said substrate and for transferring a portion of charge in said first, second and third wells into said output potential well.

28. A circuit comprising:

(a) charge-coupled means including:

(1) a well-forming means responsive to a voltage potential for forming an output well in said substrate;

(2) means for storing charge in said output potential well;

(b) circuit means coupled to said circuit means including potential converting means for providing and storing a signal indicative of said charge provided by said charge-coupled means, output means coupled to said potential converting means including second switching means for providing in response to a switching signal, an output signal indicative of the signal provided by said potential converting means, and discharge means for removing charge in said charge-coupled means at predetermined times; and (c) means for coupling said output potential to said circuit means.

29. A method using a charge-coupled device (CCD) for obtaining the sum of products of first, second, third and fourth input signals, said CCD having thereon input well-forming means for forming at least one input potential well in said CCD, said method comprising the steps of:

(a) draining electrical charge from a charge-coupled device (CCD);

(b) filling a first potential well in said CCD with a first amount of charge corresponding to said first input signal;

(c) draining into a second potential well in said CCD from said first potential well, a first portion of charge from said first amount of charge, said first portion of charge corresponding to said second input signal;

(d) filling said first potential well with a third amount of charge corresponding to said third input signal;

(e) draining into said second potential well from said first potential well a second portion of charge from said second amount of charge, said second portion of charge corresponding to said fourth input signal;

(f) filling said first potential well with a third amount of charge corresponding to a fifth input signal and then draining into said second potential well from said first potential well a third portion of charge from said third amount of charge, said third portion of charge corresponding to said fifth input signal; and (g) once repeating step "(f)".

* * * * *